US011892266B1

(12) United States Patent
Zhang

(10) Patent No.: US 11,892,266 B1
(45) Date of Patent: Feb. 6, 2024

(54) TOY ELECTRIC WATER PISTOL

(71) Applicants: Minjian Mo, Shenzhen (CN); Shantou Xiangnan Technology Co., Ltd, Shantou (CN)

(72) Inventor: Xiangjun Zhang, Shantou (CN)

( * ) Notice: Subject to any disclaimer, the term of this patent is extended or adjusted under 35 U.S.C. 154(b) by 0 days.

(21) Appl. No.: 18/216,616

(22) Filed: Jun. 30, 2023

(30) Foreign Application Priority Data

Jun. 24, 2022 (CN) ..... 202221603827.8

(51) Int. Cl.
*F41B 9/00* (2006.01)

(52) U.S. Cl.
CPC ..... *F41B 9/0037* (2013.01); *F41B 9/0075* (2013.01)

(58) Field of Classification Search
CPC ..... F41B 9/0037; F41B 9/0075; F41B 9/0078
See application file for complete search history.

(56) References Cited

U.S. PATENT DOCUMENTS 4,744,517 A * 5/1988 Iwamoto ..... B08B 3/026 239/263.3
4,768,681 A * 9/1988 Dean ..... F41B 9/0078 2/160
5,586,688 A * 12/1996 Johnson ..... F41B 9/0021 200/82 R
6,364,162 B1 * 4/2002 Johnson ..... F41B 11/54 222/61
6,474,507 B1 * 11/2002 Hornsby ..... F41B 9/0028 222/113
7,410,405 B2 * 8/2008 Hornsby ..... F41B 9/0021 446/485
7,451,900 B2 * 11/2008 Hornsby ..... B05B 1/3402 222/325
7,458,485 B2 * 12/2008 Amron ..... F41B 9/0018 239/222.11
7,837,067 B2 * 11/2010 Amron ..... F41B 9/0018 222/79
8,087,968 B2 * 1/2012 Amron ..... B05B 11/1001 446/15
10,082,361 B2 * 9/2018 Forsythe ..... F41B 9/009
10,775,128 B2 * 9/2020 Thomann ..... F41B 9/0062
2021/0236915 A1 * 8/2021 Rudell ..... A63F 13/323

* cited by examiner

*Primary Examiner* — Paul R Durand
*Assistant Examiner* — Randall A Gruby
(74) *Attorney, Agent, or Firm* — Jose Cherson Weissbrot

(57) ABSTRACT

The present invention provides a novel toy electric water pistol. The novel toy electric water pistol adopts a water suction sensing part with double sensing contacts to cooperate with a first motor in a linkage manner, so that the toy electric water pistol can be automatically and quickly processed for water suction and replenishment, without manual water addition operation, so that it is convenient to use and has high water storage efficiency. At the same time, by setting a quantitative driving jetting part, it can realize the sequential quantitative water jet jetting operation with a high response speed. The toy electric water pistol has more sufficient jetting power and a longer jetting range by combining a water jet with a conical water jet hole.

10 Claims, 2 Drawing Sheets

TOY ELECTRIC WATER PISTOL

TECHNICAL FIELD

The present invention relates to the technical field of toy water pistols, in particular to a novel toy electric water pistol.

BACKGROUND

Toy water pistol is one of the most popular toys for children, which stores the liquid in a container and endows the liquid with kinetic energy by means of pressure, so that the liquid can be ejected along a predetermined trajectory.

Many toy water pistols are also disclosed in the prior art. For example, US Patent No. 20030178439 discloses a toy water pistol, which includes a pump for pressurizing the pistol to eject water flow, a trigger for controlling the water flow, and a power supply and at least one light source for illuminating the water flow, wherein the device is suitable for providing an ignited coherent water flow.

The U.S. patent publication No. US20100213209A1 also discloses a toy water pistol, which includes a pistol body with a pistol handle, a detachable water tank arranged above the rear end of the pistol body, a muzzle part arranged at the front end of the pistol body, a pump device, a flexible hose as a waterway connecting the water tank and the muzzle part, an operating part located at the front lower part of the pistol body and capable of moving forward and backward against the pistol body, and a water stop device arranged in the middle of the flexible hose 5.

Although the toy water pistol disclosed above can pressurize water and shoot it, it needs to be manually added with water, so the water supplement efficiency is low, and the water addition amount cannot be accurately grasped during the water addition process. Moreover, the toy pistol can only shoot a continuous water column during jetting, and the water jet amount cannot be controlled, and the water storage consumption is fast, so it needs to be supplemented and added frequently, which leads to the decrease of the continuity and fun of the toy water pistol.

Based on the above problems, it is necessary to put forward a brand-new toy water pistol, which can quickly and automatically replenish water without manual operation, and can accurately control the stored water quantity. At the same time, it has novel play modes, can quantitatively shoot water, and has more powerful water power and longer range.

SUMMARY

The present invention provides a novel toy electric water gun, which comprises a toy gun body, wherein a handle is arranged on the body, and a trigger is arranged on the handle, wherein a control main board, a first motor, a water storage tank, a quantitative driving jetting part and a water flow channel communicated with the first motor, the water storage tank and the quantitative driving jetting part are accommodated in the body, wherein the control main board is electrically connected with the trigger, the first motor and the quantitative driving jetting part; a front end of the body is further provided with a water jet, a water suction port and a water suction sensing part; the water suction sensing part is electrically connected with the control main board; when the water suction sensing part senses water, the control main board controls the first motor to work and suck the water from the water suction port, and then introduces the water into the water storage tank through the water flow channel; when a user pulls the trigger, the control main board controls the quantitative driving jetting part to draw the water from the water storage tank and quantitatively eject the water from the water jet through the water flow channel; and the body is further provided with a display screen which is electrically connected with the control main board, and when the electric water gun is started, the display screen displays the real-time water storage situation in the water storage tank.

BRIEF DESCRIPTION OF DRAWINGS

In order to explain the technical scheme of this application more clearly, the drawings needed in the implementation will be briefly introduced below. Obviously, the drawings described below are only some implementations of this application. For those skilled in the art, other drawings can be obtained according to these drawings without creative work.

In the figures.

Figure 1:
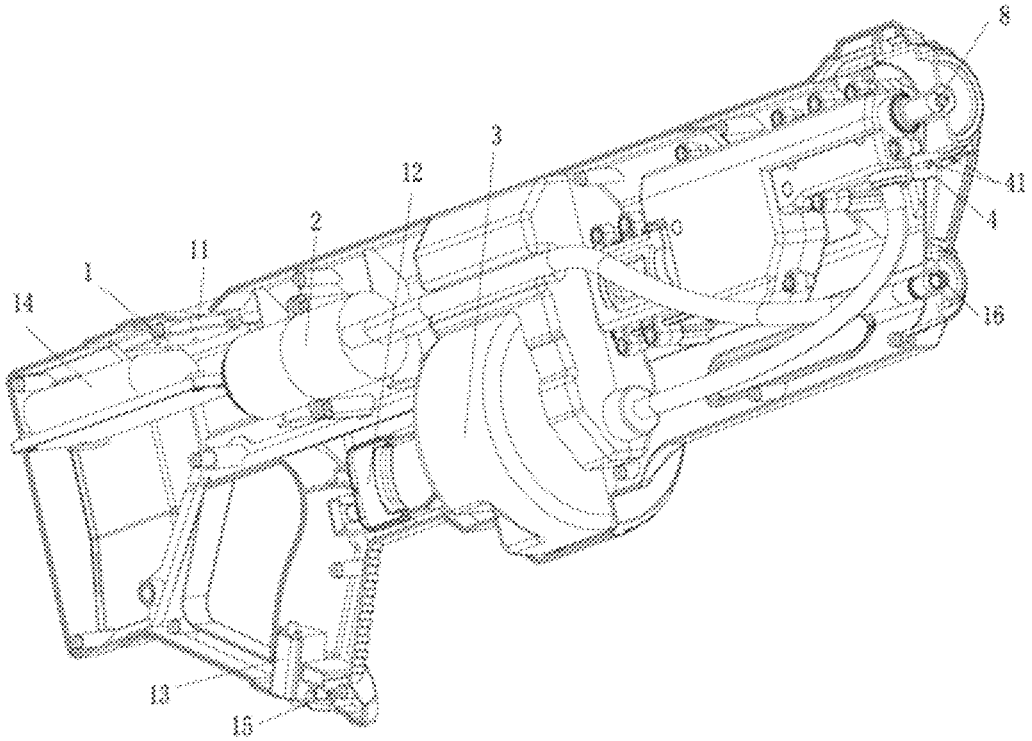
FIG. 1 is a schematic diagram of the internal structure of the present invention.

1. Control main board; 11, Display screen; 12, Trigger; 13, Charging port; 14, Power supply; 15, Power switch; 16, Water suction port; 2, First motor; 3, Water storage tank; 4, Water suction sensing part; 5, Second motor; 6, Water suction driving gear set; 7, Elastic water suction and jetting connection part; 71, Spring positioning column; 72, Compression spring; 73, Piston twitch block; 74, Piston sleeve; 75, Water suction sealing part; 751, Water suction sliding groove; 752, Water suction sealing ball; 753, Water suction sealing ring; 76, Water jet sealing part; 761, Water jet sliding groove; 762, Water jet sealing ball; 763, Water jet sealing ring; 77, Driven rack; 78, Spring limiting hole; 79, Water suction part; 41, sensing contact; 8, Water jet.

DESCRIPTION OF EMBODIMENTS

In the following, the technical scheme in the embodiment of the application will be clearly and completely described with reference to the drawings in the embodiment of the application, Obviously, the described embodiment is only a part of the embodiment of the application, but not the whole embodiment. Based on the embodiments in this application, all other embodiments obtained by those skilled in the art without creative labor belong to the protection scope of this application.

Reference to "an example or "an embodiment" herein means that a particular feature, structure or characteristic described in connection with an embodiment or an embodiment can be included in at least one embodiment of this application, The appearance of this phrase in various places in the specification does not necessarily refer to the same embodiment, nor is it an independent or alternative embodiment mutually exclusive with other embodiments, It is understood explicitly and implicitly by those skilled in the art that the embodiments described herein can be combined with other embodiments.

In this specification, for the sake of convenience, words and expressions indicating orientation or positional relationship such as "middle", "upper", "lower", "front", "rear", "vertical", "horizontal", "top", "inner" and "outer" are used to illustrate the positional relationship of constituent elements with reference to the attached drawings, only for the convenience of description, The positional relationship of the constituent elements is appropriately changed according to the direction of the described constituent elements, Therefore, it is not limited to the words and expressions described in the specification, and can be replaced appropriately according to the situation.

As shown in FIG. 1 to FIG. 4, the present invention provides a novel toy electric water gun, The novel toy electric water gun adopts a water suction sensing part with double sensing contacts to cooperate with a first motor in a linkage manner, so that water suction and water replenishment can be automatically and quickly performed on the toy electric water gun without manual water addition operation, and the water storage efficiency is high; meanwhile, by setting a quantitative driving jetting part, the water jet operation can be realized step by step, and the response speed is high; and by combining with a water jet with a conical water jet hole, the toy electric water gun has more sufficient jetting power and a longer jetting range; in addition, the water gun body is provided with a display screen with a water value scale, which is convenient for users to intuitively understand the situation of stored water; it has the advantages of fast water storage and replenishment, novel jetting mode, low water storage consumption and good play continuity.

Specifically, as shown in FIGS. 1 to 4, the present invention provides a novel toy electric water gun, wherein a handle is arranged on the body, and a trigger 12 is arranged on the handle, wherein a control main board 1, a first motor 2, a water storage tank 3, a quantitative driving jetting part and a water flow channel communicated with the first motor 2, the water storage tank 3 and the quantitative driving jetting part are accommodated in the body, wherein the control main board 1 is electrically connected with the trigger 12, the first motor 2 and the quantitative driving jetting part; a front end of the body is further provided with a water jet 8, a water suction port 16 and a water suction sensing part 4; the water suction sensing part 4 is electrically connected with the control main board 1; when the water suction sensing part 4 senses water, the control main board 1 controls the first motor 1 to work and suck the water from the water suction port 16, and then introduces the water into the water storage tank 3 through the water flow channel; when a user pulls the trigger 12, the control main board 1 controls the quantitative driving jetting part to draw the water from the water storage tank 3 and quantitatively eject the water from the water jet 8 through the water flow channel; and the body is further provided with a display screen 11 which is electrically connected with the control main board 1, and when the electric water gun is started, the display screen 11 displays the real-time water storage situation in the water storage tank 3.

In this embodiment, the water suction sensing part 4 is configured to transmit a signal to the control main board 1 after reaching the water source, and the control main board 1 controls the first motor 2 to pump water. As a preferred embodiment of the present invention, the water suction sensing part 4 includes two sensing contacts 41, which are exposed outside the outer surface of the toy body. When the two sensing contacts 41 are immersed in the water surface, a power-on sensing condition is triggered, that is, a signal is sent to the control main board to control the work of the first motor 2. In some embodiments, the water suction sensing part 4 can also be a sensing sheet, and in some embodiments, the water suction sensing part 4 can also be other sensing probes that can sense water sources. In this embodiment, the first motor 2 is a water suction pump capable of pumping water.

Figure 2:
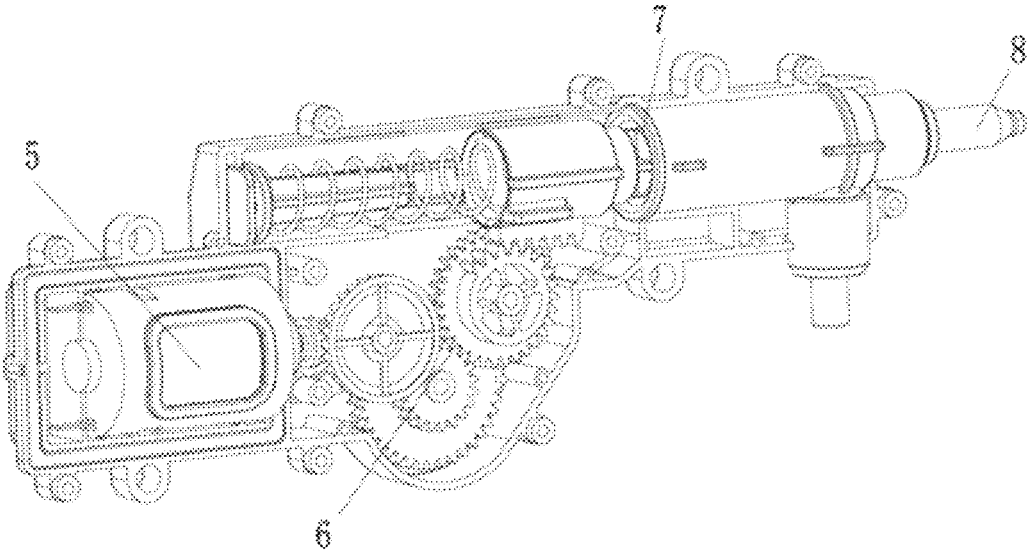
FIG. 2 is a schematic diagram of the internal structure of the quantitative driving jetting part of the present invention.

As shown in FIG. 2, the quantitative driving jetting part comprises a second motor 5, a water suction driving gear set 6 and an elastic water suction and jetting connection part 7, wherein the second motor 5 is electrically connected with the control main board 1; the transmission end of the second motor 5 is in transmission connection with the water suction driving gear set 6, and the driving end of the water suction driving gear set 6 is in transmission connection with the driven end of the elastic water suction and jetting connection part 7; when the user pulls the trigger 12, the control main board 1 receives the jetting signal, and sends a working instruction to the second motor 5, which drives the water suction driving gear set 6 to rotate, and then drives the elastic water suction and jetting connection part 7, and then the elastic water suction and jetting connection part 7 pumps water from the water storage tank 3 and jets the water.

Figure 3:
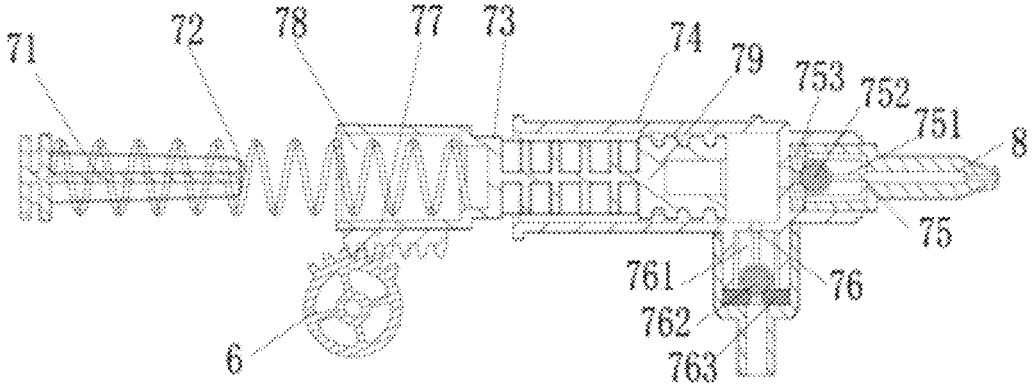
FIG. 3 is a schematic sectional view of the elastic water suction and jetting connection part of the present invention.
Figure 4:
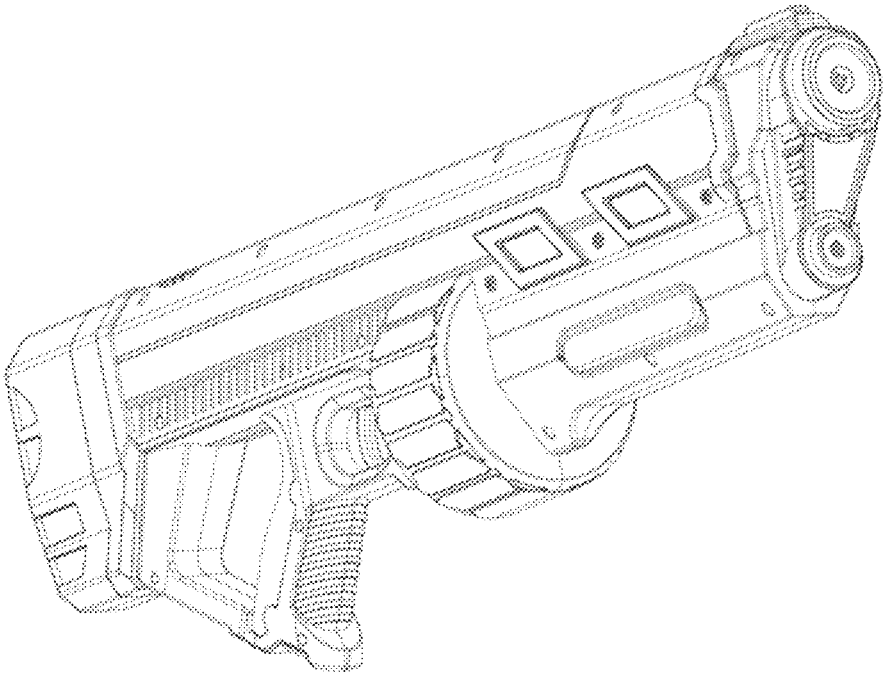
FIG. 4 is an outline structural diagram of the present invention.

Specifically, as shown in FIG. 3, the driving end of the water suction driving gear set 6 is a toothless gear, and the elastic water suction and jetting connection part 7 comprises a spring positioning column 71, a compression spring 72, a piston twitch block 73 and a piston sleeve 74, wherein a water suction sealing part 75 is arranged at a joint of a water jet hole and a water jet 8 of the piston sleeve 74, and a water jet sealing part 76 is arranged at a joint of a water suction hole and a water suction port of the piston sleeve 74; the spring positioning column 71 is arranged behind the piston twitch block 73, a driven rack 77 is also arranged below the piston twitch block 73, the piston twitch block is provided with a spring limiting hole 78, and the compression spring 72 is installed between the spring positioning column 71 and the spring limiting hole 78; a water suction part 79 is further arranged in front of the piston twitch block 73, and the water suction part 79 is arranged in the piston sleeve 74; an outer wall of the water suction part 79 is attached to an inner wall of the piston sleeve, and the driven rack 77 is meshed with the toothless gear.

In this embodiment, the toothless gear at the driving end of the water suction driving gear set 6 drives the driven rack 77 to move backward, and at the same time, the piston twitch block 73 also moves backward. At this time, the water suction part 79 moves backward in the piston sleeve 74 and compresses the compression spring 72, so that negative pressure is generated in the piston sleeve 74, and the water jet sealing part 76 is switched to the open state and the water suction sealing part 75 is switched to the closed state by this negative pressure. The water in the water storage tank 3 is pumped into the water storage cavity of the piston sleeve 74 through the water suction pipe. When the toothless gear continues to rotate until the gear teeth are disengaged from the driven rack 77, the compression spring 72 expands and resets to push the water suction part 79 forward along the inside of the piston sleeve 74, and the water jet sealing part 76 is switched to the closed state by the pressure generated by the forward push, and the water jet sealing part 75 is switched to the open state at the same time, and then the water in the piston sleeve 74 is pushed out from the water jet hole and jetted through the water jet port 8.

As a preferred implementation of the present invention, the water suction sealing part 75 includes a water suction sliding groove 751 and a water suction sealing ball 752, which are installed in the water suction sliding groove 751; the water jetting sealing part 76 includes a water jetting sliding groove 761 and a water jetting sealing ball 762, which are installed in the water jetting sliding groove 761. The air pressure difference generated by the piston sleeve 74 drives the water suction sealing ball 752 and the water jet sealing ball 762 to reciprocate in the water suction sliding groove 751 and the water jet sliding groove 761, respectively, so as to switch and adjust the open and closed states of the water suction sealing part 75 and the water jet sealing part 76.

In order to further increase the water pressure jetted by the toy water gun, a water suction sealing ring 753 is further provided between the water suction sealing ball 752 and the water jetting hole, and a water jet sealing ring 763 is further provided between the water jet sealing ball 762 and the water jet port, so that the sealing and leakage-proof effects of the water suction sealing part 75 and the water jet sealing part 76 are improved when they are in a closed state. In addition, there is a water jet channel in the water jet 8, and the pipeline area of the water jet channel decreases towards the direction close to the water jet 8, which can also pressurize the water quantity. In this real-time example, the water jet 8 is preferably configured as a conical water jet hole, and the propellant pressure on water during jetting is improved through the conical water jet hole structure.

As a preferred embodiment of the present invention, the display screen 11 capable of displaying the water quantity in the water storage tank 3 is further provided to further improve the user's experience, Specifically, as shown in FIG. 1, the display screen 11 is provided at the upper end of the toy water gun body, and a water quantity monitoring device is further provided in the water storage tank 3 and electrically connected to the control main board 1, so that the user can observe the water quantity in the water storage tank 3 in real time through the display screen 11, which greatly improves the user's experience. In some embodiments, the display screen 11 is further provided with a water quantity scale value, which can also detect the water quantity in the water storage tank 3 in real time.

In order to improve the endurance of the toy water gun, the bottom of the trigger of the toy water gun body is further provided with a charging port 13 and a power switch 15. The control main board 1 is electrically connected with a power supply 14, and the charging port 13 is electrically connected with the power supply 14, which provides working voltage for the first motor 2 and the quantitative driving jetting part, and users can charge the power supply 14 through the charging port 13 at any time.

In order to reduce the loss of the toy water gun caused by impurities in the water body and improve the service life of the toy water gun, a filter screen is also arranged at the front end of the water suction port 16. In this embodiment, the filter screen can filter impurities with a volume greater than 1 mm in the water body, and in some embodiments, users can change the size of the impurities filtered by the filter screen according to actual use requirements.

According to the novel toy electric water gun provided by the present invention, before playing, the power switch 15 is pressed for a long time to start the toy electric water gun, then the gun head part of the toy electric water gun is immersed in the water surface of the water intake part to be lowered, so that the water intake sensing part contacts with water, and the two sensing contacts are inductively connected to trigger a water intake signal, that is, a signal is sent to control the first motor 2 to act, and the first motor 2 sucks water from a water intake pipe and injects it into the water storage tank 3 through a water supply pipe. The display screen 11 shows the amount of water stored in the water storage tank 3, When the amount of water stored in the water storage tank 3 actually reaches the required value, the toy electric water gun is taken out of the water surface, the contact between the water sensing part and the water intake part is disconnected, and the first motor 2 stops the action of water suction and storage.

When playing, the trigger 12 is pulled, which controls the start-stop action of the second motor 5, and the transmission end of the second motor 5 is connected with the water suction driving gear set 6. The toothless gear rotation at the driving end of the water suction driving gear set 6 drives the piston twitch block 73 to move backward through the driven rack 77, and the water suction part 79 moves backward synchronously in the piston sleeve 74 and compresses the compression spring 72, so that negative pressure is generated in the piston sleeve 74. The water jet sealing part 76 is switched to the open state by air pressure, and the water suction sealing part 75 is switched to the closed state. At the same time, the water in the water storage tank 3 is pumped into the water storage cavity of the piston sleeve 74 through the water suction pipe. After the toothless gear continues to rotate until the gear teeth are disengaged from the driven rack 77, the compression spring 72 expands and resets to push the water suction part 79 forward along the inside of the piston sleeve 74, and the water jet sealing part 76 is switched to the closed state and the water jet sealing part 75 is switched to the open state by using the pressure generated by the forward push, so that the water in the water storage cavity of the piston sleeve 74 is pushed out from the water jet hole, and the water is jetted through the water jet hole 8 to complete the jetting. Through the cone-shaped water jet hole structure, the propellant pressure on water during jetting is improved, and the jetting power and range of the toy electric water gun are improved. After each launch, the display screen 11 decreases the scale of the corresponding water quantity value, so that the user can quickly know the remaining water quantity in the water storage tank 3.

After the first jetting, the transmission end of the second motor 5 drives the toothless gear to continue to rotate until the teeth of the toothless gear re-engage with the driven rack 77, and then the second motor 5 stops and waits for the next triggering to perform jetting again. When the water stored in the water storage tank 3 is completely jetted, the above water absorption step can be repeated. After use, the charger can be connected through the charging port 13 to charge the power supply 14, which is responsible for the first motor 2 and the quantitative driving jetting part.

The technical means disclosed in the scheme of the present invention are not limited to the technical means disclosed in the above embodiments, but also include the technical scheme composed of any combination of the above technical features. It should be pointed out that for those skilled in the art, several improvements and embellishments can be made without departing from the principle of the present invention, and these improvements and embellishments are also regarded as the protection scope of the present invention.

What is claimed is:

1. A novel toy electric water pistol, comprising: a toy pistol body, wherein a handle is arranged on the body, and a trigger is arranged on the handle, wherein a control main board, a water storage tank, a quantitative driving jetting part and a water flow channel are communicating with a first motor, and the water storage tank and the quantitative driving jetting part are accommodated in the body; wherein the control main board is electrically connected with the trigger, the first motor and the quantitative driving jetting part; a front end of the body is further provided with a water jet, a water suction port and a water suction sensing part; the water suction sensing part is electrically connected with the control main board; when the water suction sensing part senses water, the control main board controls the first motor to work and suck the water from the water suction port, and then introduces the water into the water storage tank through the water flow channel; when a user pulls the trigger, the control main board controls the quantitative driving jetting part to draw the water from the water storage tank and quantitatively eject the water from the water jet through the water flow channel; and the body is further provided with a display screen which is electrically connected with the control main board, and when the electric water pistol is started, the display screen displays the real-time water storage situation in the water storage tank.

2. The novel toy electric water pistol according to claim 1, wherein the water suction sensing part comprises at least one sensing contact, and the sensing contact is exposed outside an outer surface of the body.

3. The novel toy electric water pistol according to claim 2, wherein the quantitative driving jetting part comprises a second motor, a water suction driving gear set and an elastic water suction and jetting connection part, wherein the second motor is electrically connected with the control main board, a transmission end of the second motor is in transmission connection with the water suction driving gear set, and a driving end of the water suction driving gear set is in transmission connection with a driven end of the elastic water suction and jetting connection part.

4. The novel toy electric water pistol according to claim 3, wherein the driving end of the water suction driving gear set is a toothless gear, the elastic water suction and jetting connection part comprises a spring positioning column, a compression spring, a piston twitch block and a piston sleeve; a water suction sealing part is arranged at a joint of a water jet hole and a water jet of the piston sleeve, and a water jet sealing part is arranged at a joint of a water suction hole and a water suction port of the piston sleeve; the spring positioning column is arranged behind the piston twitch block, a driven rack is also arranged below the piston twitch block, the piston twitch block is provided with a spring limiting hole, and the compression spring is installed between the spring positioning column and the spring limiting hole; a water suction part is further arranged in front of the piston twitch block, and the water suction part is arranged in the piston sleeve; an outer wall of the water suction part is attached to an inner wall of the piston sleeve, and the driven rack is meshed with the toothless gear.

5. The novel toy electric water pistol according to claim 4, wherein the water suction sealing part comprises a water suction sliding groove and a water suction sealing ball, and the water suction sealing ball is installed in the water suction sliding groove; the water jet sealing part comprises a water jet sliding groove and a water jet sealing ball, and the water jet sealing ball is installed in the water jet sliding groove.

6. The novel toy electric water pistol according to claim 5, wherein a water suction sealing ring is arranged between the water suction sealing ball and the water jet hole, and a water jet sealing ring is arranged between the water jet sealing ball and the water suction port.

7. The novel toy electric water pistol according to claim 1, wherein the display screen is arranged at an upper end of the body, and the display screen is provided with a water scale value.

8. The novel toy electric water pistol according to claim 1, wherein a water jet channel is arranged in the water jet, and a pipeline area of the water jet channel decreases towards the direction close to the water jet.

9. The novel toy electric water pistol according to claim 1, wherein the bottom of the handle is provided with a charging port and a power switch, the control main board is electrically connected with a power supply, the charging port is electrically connected with the power supply, and the power supply provides working voltage for the first motor and the quantitative driving jetting part.

10. The novel toy electric water pistol according to claim 1, wherein a filter screen is further arranged at a front end of the water suction port, and the filter screen can filter impurities with a size greater than 1 mm in water body.

* * * * *